United States Patent [19]

Kawasaki

[11] 4,434,333

[45] Feb. 28, 1984

[54] CIRCUIT BREAKER DEVICE

[75] Inventor: Yutaka Kawasaki, Yokohama, Japan

[73] Assignee: Tokyo Shibaura Denki Kabushiki Kaisha, Kawasaki, Japan

[21] Appl. No.: 386,092

[22] Filed: Jun. 7, 1982

[30] Foreign Application Priority Data

Sep. 4, 1981 [JP] Japan ..... 56-138356

[51] Int. Cl.[3] ..... H01H 33/16

[52] U.S. Cl. ..... 200/144 AP; 200/148 A; 200/148 D

[58] Field of Search ..... 200/144 AP, 148 A, 148 D

[56] References Cited

U.S. PATENT DOCUMENTS

| | | | |
|---|---|---|---|
| 2,965,735 | 12/1960 | Baker . | |
| 2,977,446 | 3/1961 | Baker . | |
| 3,267,241 | 8/1966 | Wilson . | |
| 3,538,276 | 11/1970 | Leeds . | |
| 3,538,277 | 11/1970 | Phillips . | |
| 3,538,278 | 11/1970 | Rathbun . | |
| 3,763,340 | 10/1973 | Noack . | |
| 4,009,458 | 2/1977 | Kishi et al. | 200/144 AP |
| 4,068,108 | 1/1978 | Berneryd et al. | 200/144 AP |
| 4,263,490 | 4/1981 | Pham Van . | |
| 4,293,749 | 10/1981 | Kishi et al. . | |

FOREIGN PATENT DOCUMENTS

| | | |
|---|---|---|
| 1192290 | 5/1965 | Fed. Rep. of Germany . |
| 1225263 | 9/1966 | Fed. Rep. of Germany . |
| 1233930 | 2/1967 | Fed. Rep. of Germany . |
| 1261930 | 2/1968 | Fed. Rep. of Germany . |
| 1515652 | 12/1969 | Fed. Rep. of Germany . |
| 2741651 | 3/1979 | Fed. Rep. of Germany . |

*Primary Examiner*—E. A. Goldberg
*Assistant Examiner*—Morris Ginsburg
*Attorney, Agent, or Firm*—Cushman, Darby & Cushman

[57] ABSTRACT

A circuit breaker having main contacts in parallel with resistive contacts. Upon closing, the resistive contacts close before the main contacts to suppress switching overvoltages. A resistor is positioned between the resistive contacts so that heat may be easily dissipated, thus reducing the criticality of the value and capacitor of the resistor.

4 Claims, 4 Drawing Figures

FIG.1.
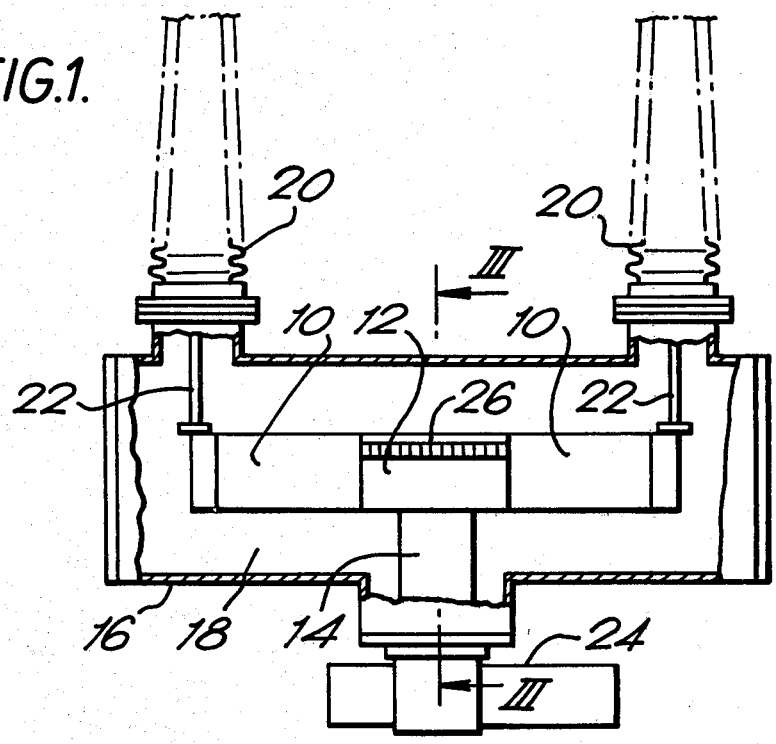
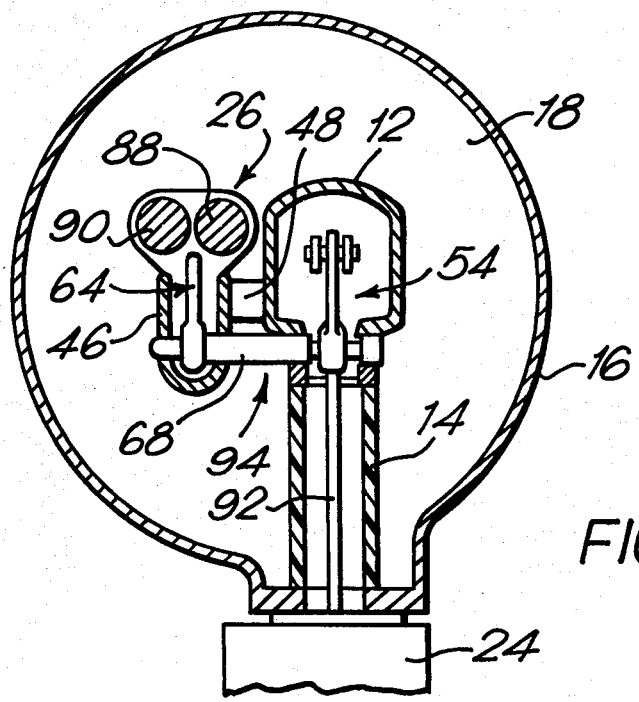
FIG.3.

CIRCUIT BREAKER DEVICE

BACKGROUND OF THE INVENTION

The present invention relates to circuit breakers which suppress switching overvoltages. More particularly the present invention relates to those circuit breakers which employ resistors to suppress overvoltages.

In transmission systems of 500 KV or over, resistance closing systems have been employed in circuit breakers wherein a resistor is connected in parallel with main contacts of the breaker before the main contacts are closed. This suppresses switching overvoltages or, more particularly, closing overvoltages when the circuit breaker is closed. Typically, a linkage coupled mechanically to the main contact is generally employed for opening and closing the contact which connects and disconnects the closing resistor. Circuit breakers including the closing resistor, and particularly those with $SF_6$ gas spraying systems, exhibit remarkably improved performance. Furthermore, it has been possible to reduce the number of breaking points. In a 500 KV system, circuit breakers with two break points have replaced circuit breakers with four break points.

However, it is necessary to consider the lowest breakdown voltage of the transmission system, the system voltage, the system surge impedance and the length of the transmission line, all of which are independent of short-circuit capacity, when determining the value of the closing resistor. Also, the heat that is dissipated during closing must also be considered. Therefore, difficulties associated with the closing resistor remain unchanged despite improvements in performance of the circuit breaker and the sharp decrease in the number of breaking points.

As the number of breaking points decreases sharply, the number of closing resistance switching contacts also decreases, reducing sharply the space needed for the circuit breaker, thus concentrating the heat that must be dissipated by the closing resistor. Consider, for example, U.S. Pat. No. 4,009,458 and Japanese Published Application No. 54-36737. These documents relate to circuit breakers in which a parallel closing resistance is employed. However, the resistance is concentrated in the contact structure associated with the resistance. Since the resistance is located in the contact, its value and capacity must be selected carefully in view of the heat that the resistor must dissipate.Also, since the heat must be dissipated from a relatively small area, miniaturization becomes difficult if not impossible. As a result, the efficient configuration of the closing resistor has become a serious matter.

SUMMARY OF THE INVENTION

To overcome the problems discussed above, it is an object of the present invention to provide a circuit breaker which is miniaturized yet includes a closing resistor.

Briefly, in accordance with one aspect of this invention, a circuit breaker device includes a pair of main contacts connected in series, each having a movable contact and a stationary contact. A pair of auxiliary contacts each have a movable contact and a stationary contact. One contact of each of the auxiliary pair is connected to opposite ends of the main contact pair. A resistance is physically disposed between the auxiliary contacts and is electrically connected between the other contacts of the auxiliary pair. The main and auxiliary contacts and the resistance are all disposed in a tank filled with an insulating gas. A device is provided for operating both the main and auxiliary contacts in such a way that the auxiliary contacts close before the main contacts.

Since the resistance is located between the auxiliary or resistance contacts, it can dissipate heat better than resistances in prior attempts to miniaturize circuit breakers. Therefore, the selection of the value and capacity of the resistance is less critical than in the prior art, and, in fact, miniaturization is possible.

BRIEF DESCRIPTION OF THE DRAWINGS

A more complete appreciation of the invention will be readily obtained as the same becomes better understood by reference to the following detailed description when considered in connection with the accompanying drawings, wherein:

FIG. 1 is a partially broken sectional side view of a circuit breaker device according to a preferred embodiment of this invention;

FIG. 3 is a sectional view taken along line III—III of FIG. 1; and

DETAILED DESCRIPTION OF THE PRESENTLY PREFERRED EMBODIMENT

Figure 2:
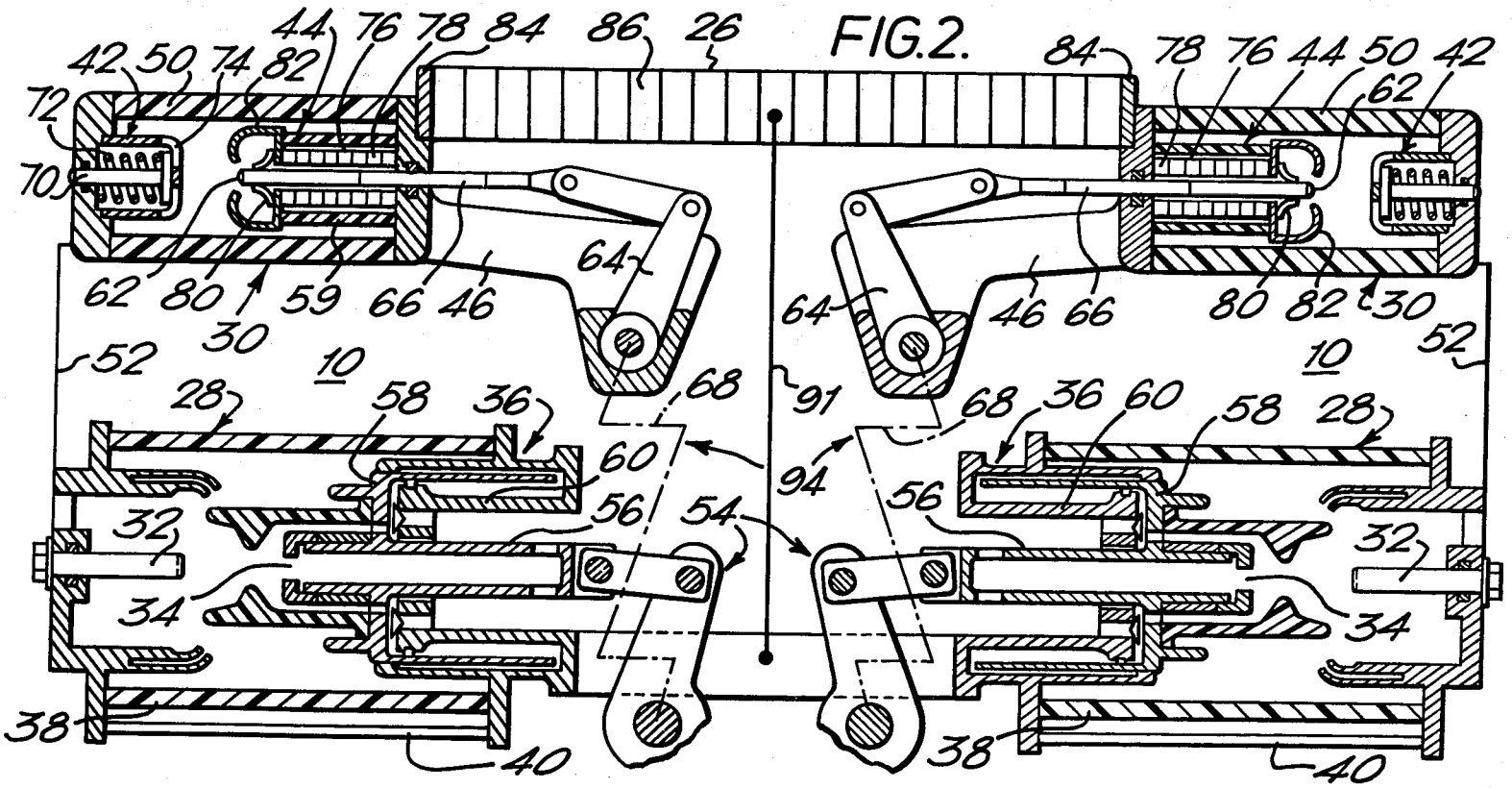
FIG. 2 is a schematic sectional view of the breaking unit shown in FIG. 1 with the main contacts shifted vertically to show the auxiliary contacts.

The invention will now be described with reference to the preferred embodiment illustrated in the accompanying drawings. In FIG. 1, a double-break circuit breaker, for example, includes two breaking units 10 connected through a center piece 12. Center piece 12 is supported by an insulating cylinder 14 in a tank 16 filled with an insulating gas 18, such as $SF_6$. Electricity from breaking units 10 is conducted outside tank 16 through bushings 20 which have center conductors 22 connected to breaking units 10. Both breaking units 10 are coupled to an actuator 24 provided externally to tank 16. A resistor 26 is arranged along a side surface of center piece 12 between breaking units 10.

While not illustrated in detail, it goes without saying that the present invention can be employed with quadruple-break or other multiples of circuit breakers by ganging the breaking units 10.

FIG. 2 illustrates the two breaking units 10. Since the two breaking units 10 are the same, only one will be described in detail below.

Each breaking unit 10 consists of a main contact breaking unit 28 and a resistance contact unit 30 arranged in parallel therewith. Each main contact breaking unit 28 includes a fixed main contact 32, a moving main contact 34 and a conductive buffer unit 36 adjacent to moving main contact 34. Fixed main contact 32 is supported on buffer unit 36 through an insulating cylinder 38. Buffer unit 36 is mounted on and electrically connected to center piece 12 so as to electrically connect moving main contacts 34. A potential dividing capacitor 40 is provided on the outer periphery of insulating cylinder 38 to balance the potential applied to each main contact breaking unit 28.

Each resistance contact unit 30 includes a fixed resistance contact 42 and a moving resistance contact 44.

Moving resistance contact 44 is mounted on a case 46, and case 46 is supported on and fixed to center piece 12 through an insulated bearing member 48 (FIG. 3). Fixed resistance contact 42 is supported on case 46 through an insulating cylinder 50 and is electrically and mechanically connected to fixed main contact 32 through a connector 52.

Moving main contact 34 of main contact breaking unit 28 is coupled to linkage 54 through an electrode rod 56 together with a buffer cyclinder 58 of buffer unit 36. A buffer piston 60 of buffer unit 36 is fixed to center piece 12.

A traveling contact 62 of moving resistance contact 44 of resistance contact unit 30 is coupled to linkage 64 through an insulating rod 66. Further, both linkages 54 and 64 are coupled through an insulated shaft 68 as illustrated in FIG. 3 and indicated schematically by an alternately long and short dash line in FIG. 2.

Fixed resistance contact 42 of resistance contact unit 30 is formed to enclose a fixed contact 70 pressed by a wipe spring 72 consisting of a compression spring in a shield 74. Moving resistance contact 44 includes a resistor 76 formed by laminating a number of annular resistor elements 78. Resistor 76, enclosed in insulating cylinder 59 mounted on case 46, comes in contact with traveling contact 62 inserted in the hollow zone of the resistor 76 through a contact-maker 80 of a shield 82 mounted on the end of insulating cylinder 59 opposite case 46, and the resistor 76 is inserted in series between traveling contact 62 and case 46 which is conductive. Recall that case 46 is fixed on center piece 12 through insulated bearing member 48.

Figure 4:
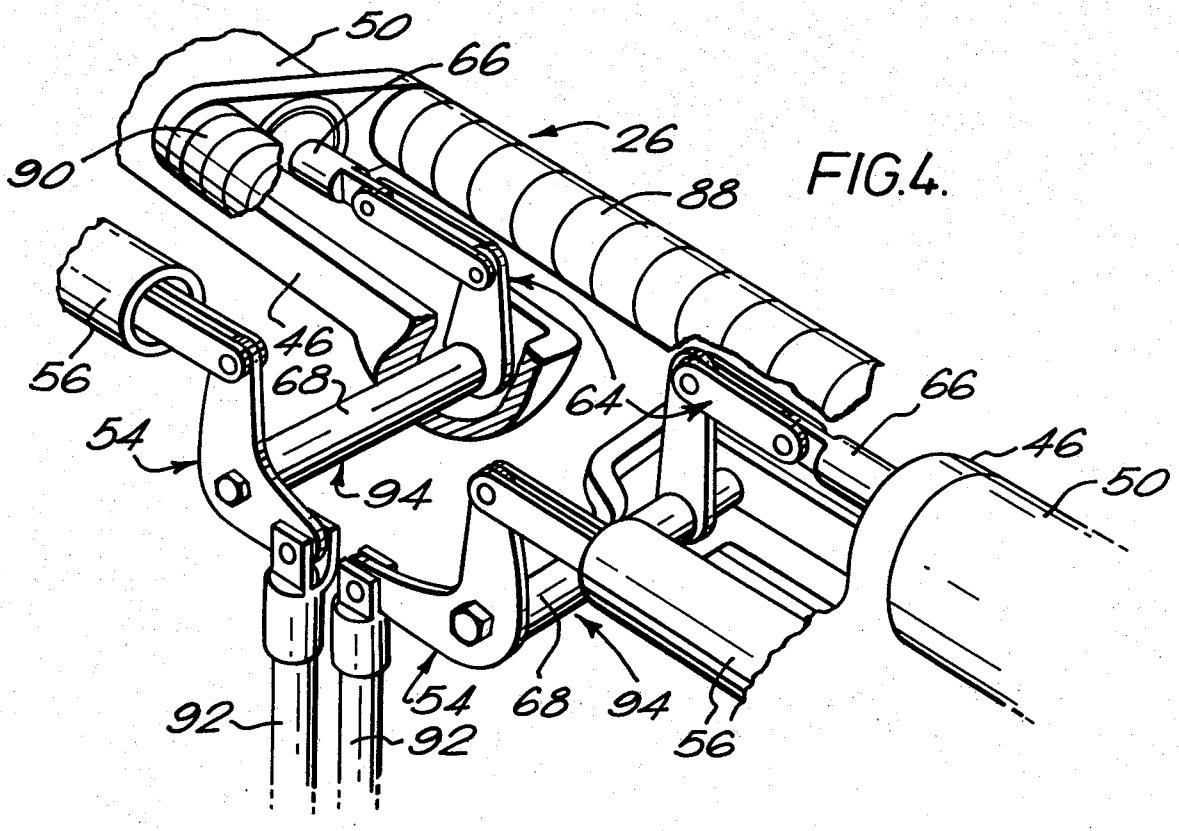
FIG. 4 is a partially broken perspective view illustrating the coupling mechanism of the preferred embodiment of the present invention.

Resistor 26 is connected between cases 46 for the two moving resistance contacts 44 through end plates 84. Resistor 26 is a lamination of a plurality of resistor elements 86 and may be arranged as a single piece or a number of pieces in parallel according to the desired resistance value and capacity. FIGS. 3 and 4 illustrate an embodiment in which resistor 26 includes two pieces 88 and 90 connected in parallel.

FIG. 2 illustrates a preferred embodiment of this invention in which a wire 91 is connected at one end to some point along resistor 26 and at the other end to the electrical juncture between moving main contacts 34. Thus wire 91 is an intermediate tap along resistor 26. Although wire 91 is not necessary, it does assist in balancing the voltage drop along resistor 26.

As illustrated in FIGS. 3 and 4, linkage 54 in center piece 12 is supported by and disposed within insulating cylinder 14. Linkage 54 is coupled with actuator 24 through an insulated operating rod 92. Case 46 is supported by and fixed to center piece 12 through insulated bearing member 48. Linkage 64 is disposed in case 46 and is coupled with linkage 54 through insulated shaft 68 forming a coupling mechanism 94. Pieces 88 and 90 of resistor 26 are mounted in parallel between cases 46.

The operation of the circuit breaker according to the invention will now be described. When a closing command is given to actuator 24, a driving force is transferred to coupling mechanism 94 through insulated operating rod 92. Main contact breaking units 28 begin to close as driven by linkage 54. At the same time, the driving force is transferred to linkage 64 through insulated shaft 68. This causes moving resistance contacts 44 of resistance contact units 30 to begin closing. Since the closing times of traveling contacts 62 will be shorter than that of main contact breaking units 28, traveling contacts 62 close first, even if main contact breaking units 28 and resistance contact units 30 begin closing at the same time. As closing proceeds, both resistors 76 and resistor 26 become connected in series between fixed main contacts 32. Then, main contact breaking units 28 close after a given period of time, and resistors 76 and 26 are short-circuited to complete the closing operation.

The procedure for opening the circuit breaker is the reverse of the closing procedure. Thus springs wipe fixed contacts 70 of resistance contact units 30. However, since moving main contacts 34 and moving resistance contacts 44 are moving rapidly, fixed contacts 70 cannot follow moving contacts 62 so that resistance contact units 30 open first and insulation provided by gas 18 between the contacts recovers antecedently to the opening of main contact breaking units 28. Therefore current is cut off by main contact breaking units 28.

Since resistance 26 is disposed between resistance contact units 30, it can dissipate heat better than the resistance in prior attempts to miniaturize circuit breakers. Therefore, the selection of the resistance value and capacity of resistors 76 and 26 is less critical than in the prior art despite a reduction in the number of break points, thus maintaining the superior closing performance of the present invention.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed is:

1. A circuit breaker device comprising: a tank filled with an insulating gas;

a pair of main contacts disposed in said tank, connected in series with each other and each having a movable contact and a fixed contact;

a pair of auxiliary contacts disposed in said tank, each having a movable contact and a fixed contact, an end terminal of one of said auxiliary contacts being connected with an end terminal of said series connected main contacts and an end terminal of the other of said auxiliary contacts being connected with the other end terminal of said series connected main contacts, each of said auxiliary contacts including a resistance annularly disposed around said movable contact of said auxiliary contact, said movable contact passing through and electrically contacting the annular resistance;

a resistance, disposed in said tank, connected to the other end terminals of said auxiliary contacts, said resistance including an intermediate tap connected to a juncture point between said main contacts; and operating means, including an insulated rod connected between said movable contacts of said main and auxiliary contacts, for closing and opening said pairs of main contacts and auxiliary contacts, said operating means cooperating with said pairs of contacts to close said auxiliary contacts before said main contacts.

2. A circuit breaker device as recited in claim 1, wherein said main contacts are physically disposed parallel with said auxiliary contacts.

3. A circuit breaker device as recited in claim 1, further comprising a capacitor connected between said fixed contact and said movable contact of each of said main contacts.

4. In a circuit breaker comprising a first plurality of breaking units connected in series to form a main contact unit, and a plurality of second breaking units connected in series and forming a resistance contact unit connected in parallel with said main contact unit, each of said breaking units of said resistance contact unit including a first resistor, all current passing through each breaking unit of said resistance contact unit also passing through the associated first resistor, the improvement comprising:

a capacitor connected between a fixed contact and a moving contact of each of said first breaking units;

insulated supporting means for connecting each of said breaking units of said resistance contact unit to said main contact unit;

linking means for operating said main contact unit;

insulating means for operatively coupling said resistance contact unit to said main contact unit, said linking means and insulating means cooperating to close said resistance contact unit prior to said main contact unit during closing; and a second resistor connected in series between said breaking units of said resistance contact unit.

* * * * *